US011267681B2

(12) United States Patent
Goto et al.

(10) Patent No.: US 11,267,681 B2
(45) Date of Patent: Mar. 8, 2022

(54) CRANE

(71) Applicant: TADANO LTD., Kagawa (JP)

(72) Inventors: Tomokazu Goto, Kagawa (JP); Shinsuke Kanda, Kagawa (JP); Kazuma Mizuki, Kagawa (JP)

(73) Assignee: TADANO LTD., Kagawa (JP)

( * ) Notice: Subject to any disclaimer, the term of this patent is extended or adjusted under 35 U.S.C. 154(b) by 0 days.

(21) Appl. No.: 16/976,275

(22) PCT Filed: Feb. 28, 2019

(86) PCT No.: PCT/JP2019/007769
§ 371 (c)(1),
(2) Date: Aug. 27, 2020

(87) PCT Pub. No.: WO2019/168087
PCT Pub. Date: Sep. 6, 2019

(65) Prior Publication Data

US 2021/0053800 A1 Feb. 25, 2021

(30) Foreign Application Priority Data

Feb. 28, 2018 (JP) ..... JP2018-035210

(51) Int. Cl.
*B66C 13/00* (2006.01)
*B66C 13/18* (2006.01)

(52) U.S. Cl.
CPC ..... *B66C 13/18* (2013.01); *B66C 2700/085* (2013.01)

(58) Field of Classification Search
CPC ..... B66C 13/063; B66C 13/14; B66C 13/18; B66C 13/40; B66C 23/04; B66C 23/06; B66C 2700/085
See application file for complete search history.

(56) References Cited

U.S. PATENT DOCUMENTS 3,624,783 A * 11/1971 Chang ..... B66C 13/30 254/275
5,785,191 A * 7/1998 Feddema ..... B66C 13/063 212/275

(Continued)

FOREIGN PATENT DOCUMENTS

EP 1149796 A2 * 10/2001 ..... B66C 13/22
EP 1652810 B1 12/2012

(Continued)

OTHER PUBLICATIONS

Apr. 16, 2019, International Search Report issued for related PCT Application No. PCT/JP2019/007769.

(Continued)

*Primary Examiner* — Emmanuel M Marcelo
(74) *Attorney, Agent, or Firm* — Paratus Law Group, PLLC

(57) ABSTRACT

This crane is provided with: a operable functional unit; an operation unit for receiving an operation input for operating the operable functional unit; an actuator that drives the operable functional unit; a first generation unit that generates a first control signal for the actuator on the basis of the operation input; a switch unit that can be switched between a first state and a second state; a first filter unit that filters the first control signal to generate a second control signal when the switch unit is in the second state; and a control unit that controls the actuator on the basis of the first control signal when the switch unit is in the first state, and controls the actuator on the basis of the second control signal when the switch unit is in the second state.

10 Claims, 16 Drawing Sheets

(56) References Cited

U.S. PATENT DOCUMENTS

| | | | | |
|---|---|---|---|---|
| 6,442,439 | B1 | 8/2002 | Robinett, III et al. | |
| 2002/0017189 | A1* | 2/2002 | Nishimura | E02F 9/26 91/459 |
| 2006/0175276 | A1 | 8/2006 | Hytonen | |
| 2007/0219662 | A1* | 9/2007 | Sawodny | B66C 23/62 700/213 |
| 2018/0347149 | A1* | 12/2018 | Tomita | F15B 21/02 |

FOREIGN PATENT DOCUMENTS

| | | | | |
|---|---|---|---|---|
| JP | H0598671 | A * | 4/1993 | B66C 13/22 |
| JP | 2015-151211 | A | 8/2015 | |
| WO | WO 2005/007553 | A1 | 1/2005 | |

OTHER PUBLICATIONS

Apr. 16, 2019, International Search Opinion issued for related PCT Application No. PCT/JP2019/007769.

Oct. 20, 2021, European Search Report issued for related EP Application No. 19760219.6.

* cited by examiner

CRANE

CROSS REFERENCE TO PRIOR APPLICATION

This application is a National Stage Patent Application of PCT International Patent Application No. PCT/JP2019/007769 (filed on Feb. 28, 2019) under 35 U.S.C. § 371, which claims priority to Japanese Patent Application No. 2018-035210 (filed on Feb. 28, 2018), which are all hereby incorporated by reference in their entirety.

TECHNICAL FIELD

The present invention relates to a crane.

BACKGROUND ART

Conventionally, a crane has been known as a typical work vehicle. The crane is mainly composed of a traveling body and a turning body. The traveling body includes a plurality of wheels, and is configured to travel freely. The turning body includes a boom, a wire rope, a hook, and the like. Such a turning body is configured to be able to carry load. Further, such a crane is provided with an actuator for carrying a load and a control device for instructing an operating state of the actuator.

By the way, a crane has been proposed in which a control device creates a filtering control signal and controls an actuator on the basis of the filtering control signal (see Patent Literature 1). Here, the filtering control signal means a signal obtained by applying a filter having a predetermined characteristic to a basic control signal of the actuator. For example, the filter may be a notch filter. The notch filter has a characteristic that the attenuation rate increases as it approaches the resonance frequency in an arbitrary range centered on the resonance frequency. The resonance frequency is calculated on the basis of the suspension length of the hook.

Here, it is assumed that the above-mentioned actuator is a turning hydraulic motor and the turning operation of the boom is manually stopped. In this case, even if the operator stops the swinging motion of the boom, the turning operation continues for a while as the boom slows down. This is because the turning operation of the boom is not immediately stopped, but the deceleration section on the basis of the filtering control signal is provided to suppress the swing of the load. However, such a characteristic means that the turning operation of the boom does not match the operation by the operator, and there is a problem that the more experienced the operator, the greater the discomfort. Therefore, there is a demand for a crane that can select an operation characteristic with respect to a control mode of a load transport operation.

CITATION LIST

Patent Literature

Patent Literature 1: JP 2015-151211 A

SUMMARY OF THE INVENTION

Problems to be Solved by the Invention

An object of the invention is to provide a crane capable of selecting an operation characteristic with respect to a control mode of a load transport operation.

Solutions to Problems

An aspect of a crane according to the invention includes a operable functional unit, an operation unit that receives an operation input for operating the operable functional unit, an actuator that drives the operable functional unit, a first generation unit that generates a first control signal for the actuator on the basis of the operation input, a switch unit that can be switched between a first state and a second state, a first filter unit that filters the first control signal to generate a second control signal when the switch unit is in the second state, and a control unit that controls the actuator on the basis of the first control signal when the switch unit is in the first state, and controls the actuator on the basis of the second control signal when the switch unit is in the second state.

Effects of the Invention

According to this invention, it is possible to provide a crane which can select an operation characteristic with respect to a control mode of a load transport operation.

DESCRIPTION OF EMBODIMENTS

Figure 1:
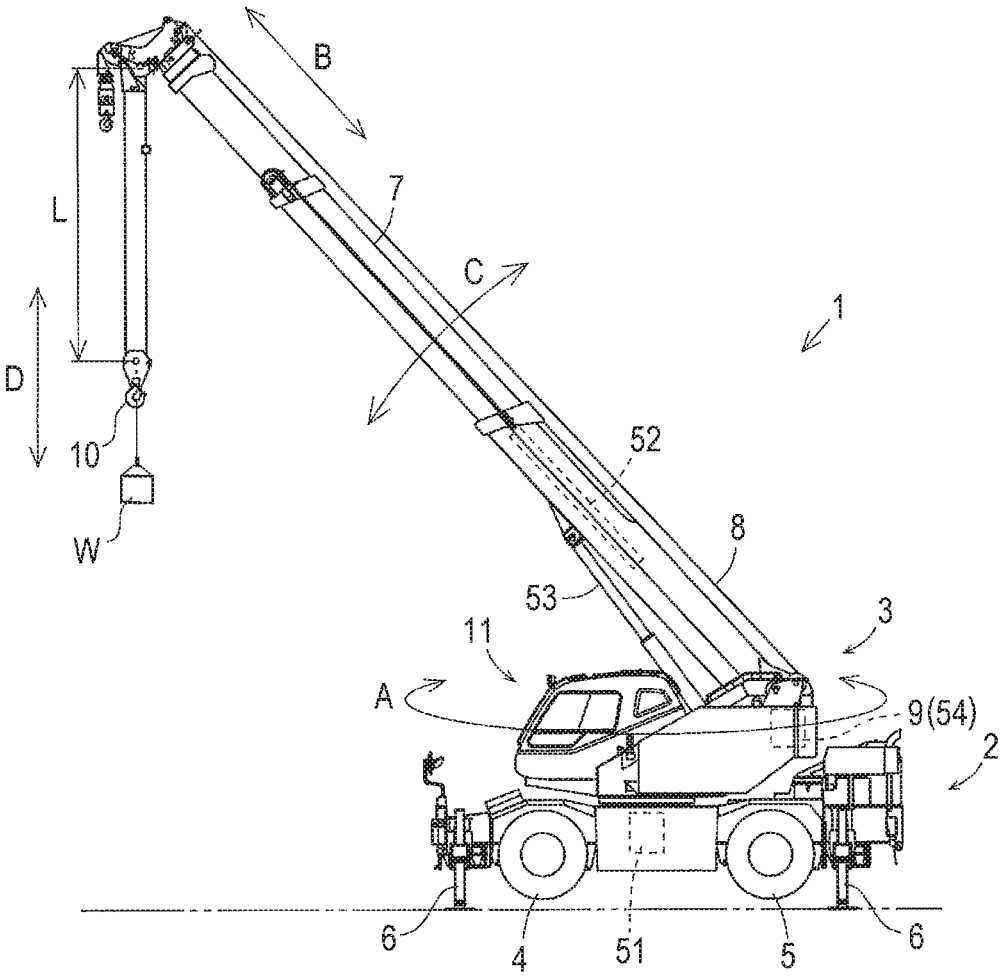
FIG. 1 is a diagram illustrating a crane.

The technical ideas disclosed in the present application can be applied to various cranes in addition to a crane 1 described below.

First, the crane 1 will be described with reference to FIG. 1.

The crane 1 is mainly composed of a traveling body 2 and a turning body 3.

The traveling body 2 includes a pair of left and right front tires 4 and rear tires 5. In addition, the traveling body 2 is provided with an outrigger 6 which is grounded and stabilized when carrying the load W. The turning body 3 is supported on the upper part of the traveling body 2. Such a turning body 3 can be freely turned by an actuator.

The turning body 3 is provided with a boom 7 so as to project forward from the rear part thereof. Therefore, the boom 7 can be freely turned by an actuator (see arrow A). Further, the boom 7 can be freely extended and contracted by an actuator (see arrow B).

Further, the boom 7 can be freely raised and lowered by an actuator (see arrow C). In addition, a wire rope 8 is stretched over the boom 7. A winch 9 around which the wire rope 8 is wound is disposed on the base end side of the boom 7, and a hook 10 is suspended by the wire rope 8 on the tip end side of the boom 7.

The winch 9 is configured integrally with the actuator, and allows the wire rope 8 to be wound and unwound. Therefore, the hook 10 can be freely raised and lowered by the actuator (see arrow D). The turning body 3 is provided with a cabin 11 on the side of the boom 7. The winch 9 corresponds to an example of a operable functional unit.

Figure 2:
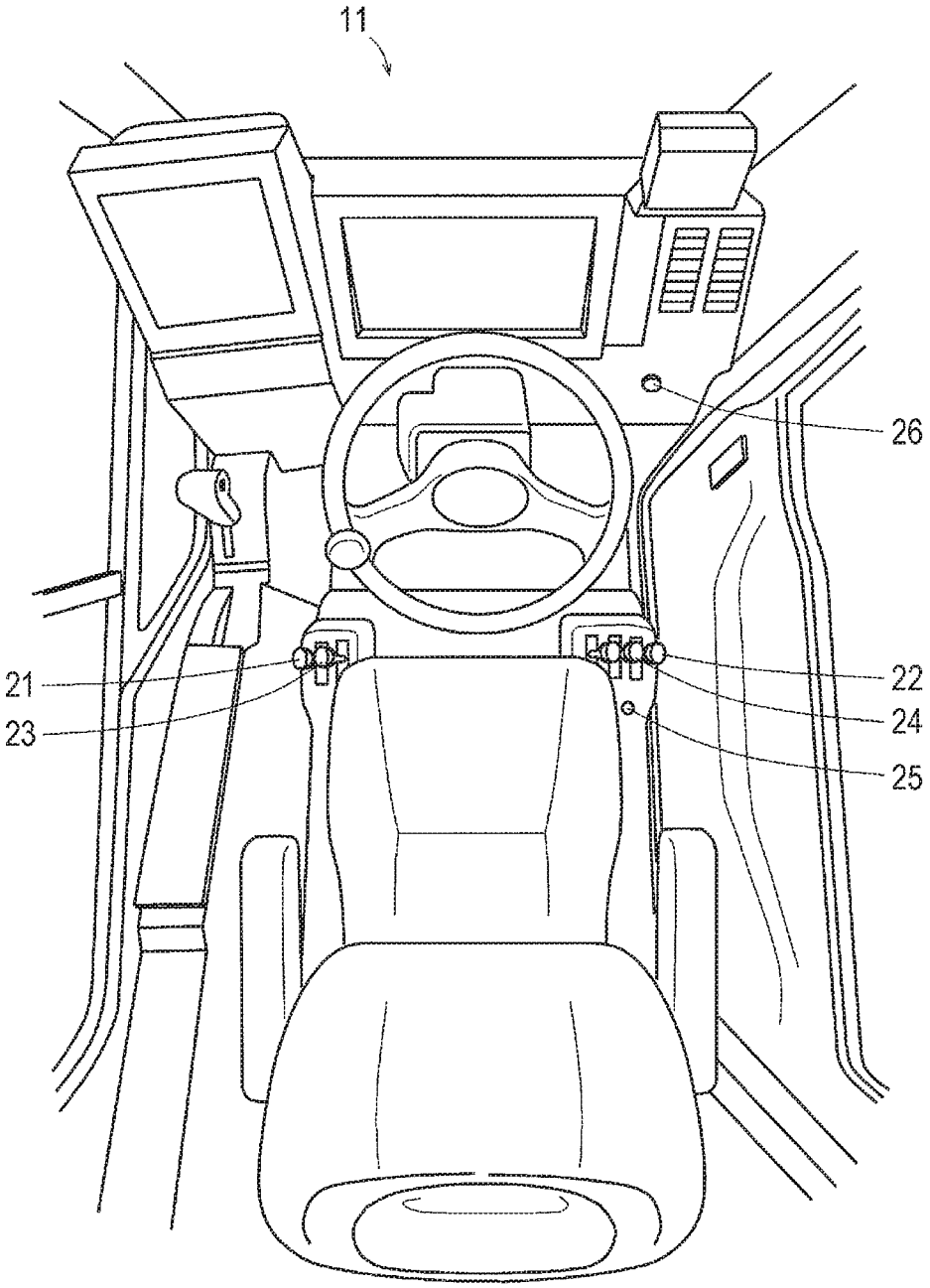
FIG. 2 is a diagram illustrating the inside of a cabin.

As illustrated in FIG. 2, a turning operation tool 21, a telescopic operation tool 22, a derricking operation tool 23, and a winding operation tool 24, which will be described later, are provided inside the cabin 11. Further, the cabin 11 is provided with a changeover switch 25. Each of these operation units 21 to 24 corresponds to an example of the operation unit. The operation unit receives an operation input for operating the operable functional unit.

Figure 3:
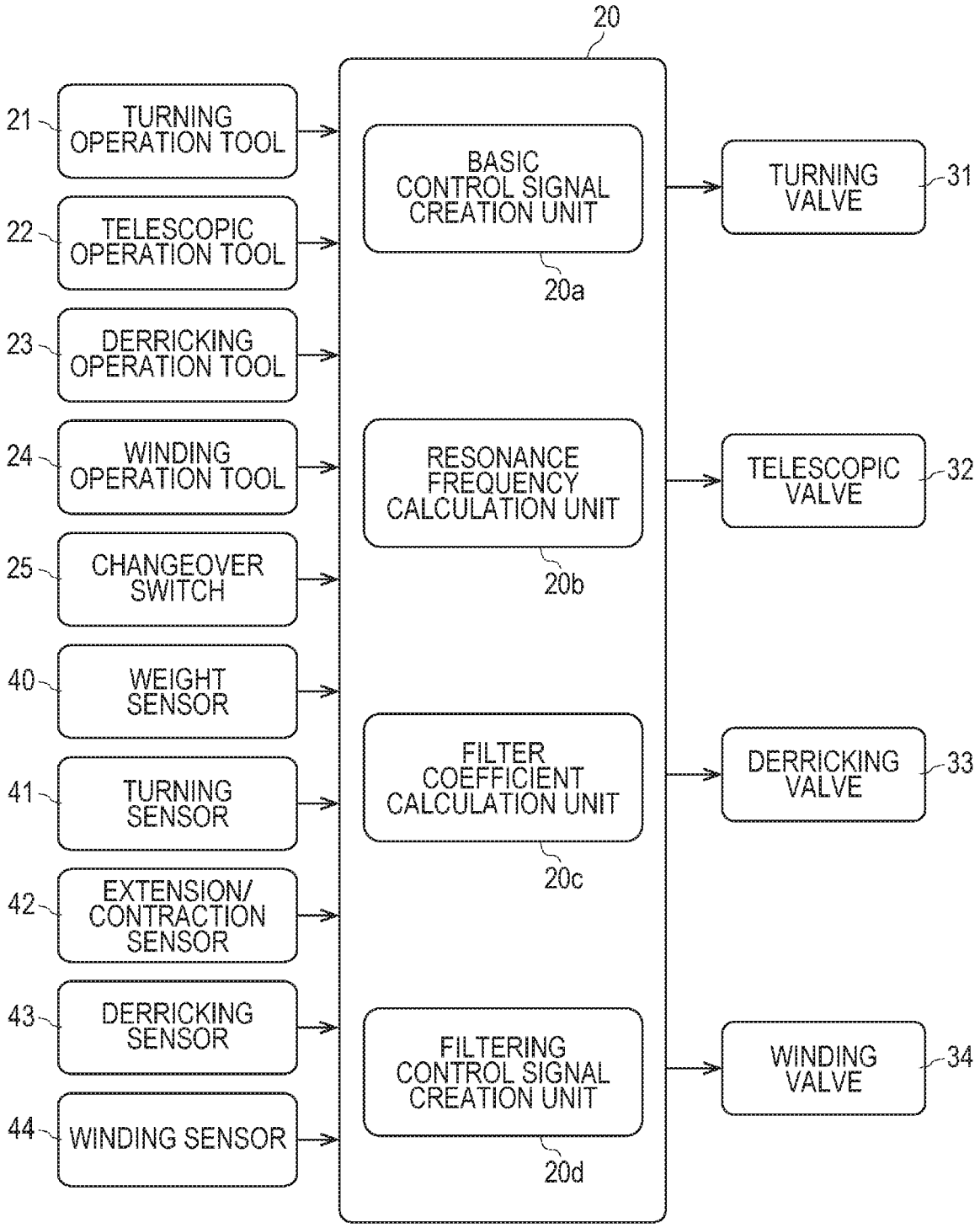
FIG. 3 is a diagram illustrating the configuration of a control system.

Next, the control system will be described with reference to FIG. 3. However, the present control system is an example of a conceivable configuration and is not limited to this.

The control system is mainly configured by a control device 20. Various operation tools 21 to 24 are connected to the control device 20. Further, the control device 20 is connected with a turning valve 31, a telescopic valve 32, a derricking valve 33, and a winding valve 34.

Further, the control device 20 is connected to a weight sensor 40, a turning sensor 41, an extension/contraction sensor 42, a derricking sensor 43, and a winding sensor 44. The weight sensor 40 can detect the weight of the load W. Therefore, the control device 20 can recognize the weight of the load W.

As described above, the boom 7 is freely turned by the actuator (see arrow A in FIG. 1). In the present application, a turning hydraulic motor 51 corresponds to an example of the actuator. The turning hydraulic motor 51 is appropriately operated by the turning valve 31 which is an electromagnetic proportional switching valve.

That is, the turning hydraulic motor 51 is appropriately operated by the turning valve 31 switching the flow direction of the hydraulic oil or adjusting the flow rate of the hydraulic oil. Further, the turning angle and the turning speed of the boom 7 are detected by the turning sensor 41. Therefore, the control device 20 can recognize the turning angle and the turning speed of the boom 7.

Further, as described above, the boom 7 can be freely expanded and contracted by the actuator (see arrow B in FIG. 1). A telescopic hydraulic cylinder 52 corresponds to an example of the actuator. The telescopic hydraulic cylinder 52 is appropriately operated by the telescopic valve 32 which is an electromagnetic proportional switching valve.

That is, the telescopic hydraulic cylinder 52 is appropriately operated by the telescopic valve 32 switching the flow direction of the hydraulic oil or adjusting the flow rate of the hydraulic oil. The extension/contraction length and extension/contraction speed of the boom 7 are detected by the extension/contraction sensor 42. Therefore, the control device 20 can recognize the extension/contraction length and the extension/contraction speed of the boom 7.

Further, as described above, the boom 7 is freely raised and lowered by the actuator (see arrow C in FIG. 1). A derricking hydraulic cylinder 53 corresponds to an example of the actuator. The derricking hydraulic cylinder 53 is appropriately operated by the derricking valve 33 which is an electromagnetic proportional switching valve.

That is, the derricking hydraulic cylinder 53 is appropriately operated by the derricking valve 33 switching the flow direction of the hydraulic oil or adjusting the flow rate of the hydraulic oil. The derricking angle and derricking speed of the boom 7 are detected by the derricking sensor 43. Therefore, the control device 20 can recognize the derricking angle and derricking speed of the boom 7.

In addition, as described above, the hook 10 is freely raised and lowered by the actuator (see arrow D in FIG. 1). A winding hydraulic motor 54 corresponds to an example of the actuator. The winding hydraulic motor 54 is appropriately operated by the winding valve 34 which is an electromagnetic proportional switching valve.

That is, the winding hydraulic motor 54 is appropriately operated by the winding valve 34 switching the flow direction of the hydraulic oil or adjusting the flow rate of the hydraulic oil. The suspension length L (see FIG. 1) and the lifting speed of the hook 10 are detected by the winding sensor 44. Therefore, the control device 20 can recognize the suspension length L and the lifting speed of the hook 10.

By the way, the control device 20 controls each actuator (51, 52, 53, 54) via various valves 31 to 34. The control device 20 includes a basic control signal creation unit 20*a*, a resonance frequency calculation unit 20*b*, a filter coefficient calculation unit 20*c*, and a filtering control signal creation unit 20*d*. The filtering control signal creation unit 20*d* may be regarded as an example of the first filter unit and the second filter unit. The first filter unit filters the first control signal to generate a second control signal. The second filter unit filters the third control signal to generate a fourth control signal. The first filter unit and the second filter unit may have different filter characteristics. That is, the filter coefficient of the first filter unit and the filter coefficient of the second filter unit may be different. The first filter unit and the second filter unit may have the same filter characteristics.

Figure 5:
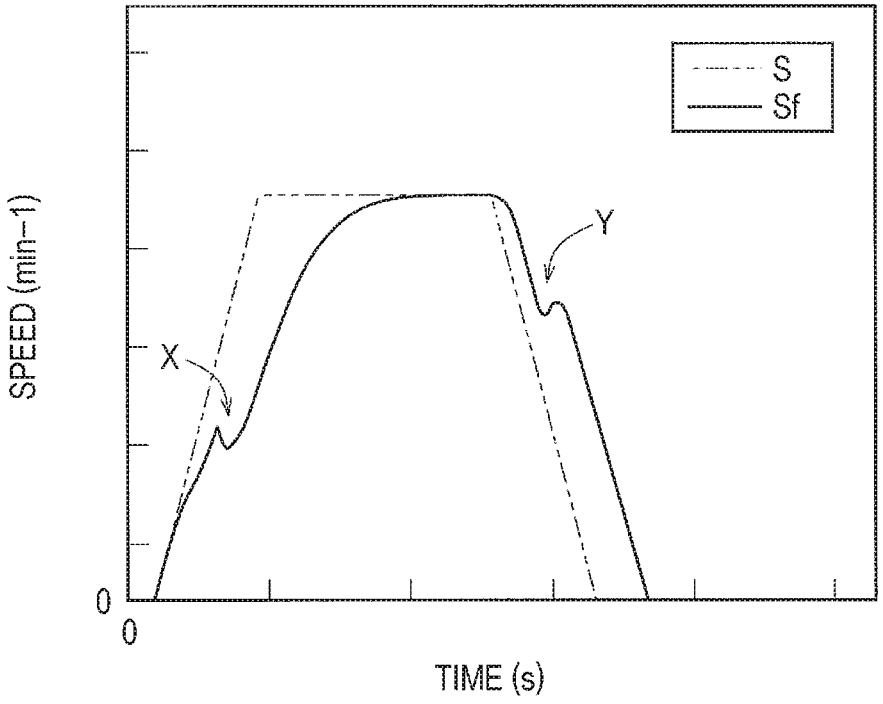
FIG. 5 is a diagram illustrating a basic control signal and a filtering control signal.

The basic control signal creation unit 20*a* creates a basic control signal S that is a speed command for each actuator (51, 52, 53, 54) (see FIG. 5). The basic control signal creation unit 20*a* recognizes the operation amount and the operation speed of the various operation tools 21 to 24 by the operator, and creates the basic control signal S for each situation.

Specifically, the basic control signal creation unit 20*a* creates a basic control signal S according to the operation amount and the operation speed of the turning operation tool 21, a basic control signal S according to the operation amount and the operation speed of the telescopic operation tool 22, a basic control signal S according to the operation amount and operation speed of the derricking operation tool 23, and/or a basic control signal S according to the operation amount and operation speed of the winding operation tool 24. The basic control signal creation unit 20*a* corresponds to an example of the first generation unit.

The resonance frequency calculation unit 20*b* calculates a resonance frequency ω which is a swing frequency of the load W caused by the operation of each actuator (51, 52, 53, 54). The resonance frequency calculation unit 20*b* recognizes the suspension length L of the hook 10 on the basis of the posture of the boom 7 and the unwinding amount of the wire rope 8, and calculates the resonance frequency G for each situation.

Specifically, the resonance frequency calculation unit 20*b* calculates the resonance frequency ω on the basis of the following expression using the suspension length L of the hook 10 and the gravitational acceleration g.

$$\omega=\sqrt{(g/L)} \quad \text{[Math. 1]}$$

The filter coefficient calculation unit 20*c* calculates a center frequency coefficient ωn, a notch width coefficient ζ, and a notch depth coefficient δ of a transfer coefficient H(s) included in the notch filter F described later. The filter coefficient calculation unit 20*c* calculates the corresponding center frequency coefficient ωn with the resonance frequency ω calculated by the resonance frequency calculation unit 20*b* as a center.

In addition, the filter coefficient calculation unit 20*c* calculates the notch width coefficient ζ and the notch depth coefficient δ corresponding to each basic control signal S. The transfer coefficient H(s) is represented by the following expression using the center frequency coefficient ωn, the notch width coefficient ζ, and the notch depth coefficient δ. The transfer coefficient H(s) is also called a filter characteristic. If the parameters of the transfer coefficient H(s) are different, it may be considered that the filter characteristics of the notch filter F are different.

$$H(s)=\frac{s^2+2\delta\zeta\omega_n s+\omega_n^2}{s^2+2\zeta\omega_n s+\omega_n^2} \quad \text{[Math. 2]}$$

The filtering control signal creation unit 20*d* creates the notch filter F, and also applies the notch filter F to the basic control signal S to create a filtering control signal Sf (see FIG. 5). The filtering control signal creation unit 20*d* creates the notch filter F by acquiring the various coefficients on, ζ, and δ from the filter coefficient calculation unit 20*c*.

Further, the filtering control signal creation unit 20*d* acquires the basic control signal S from the basic control signal creation unit 20*a*, applies the notch filter F to the basic control signal S, and creates the filtering control signal Sf.

Specifically, the filtering control signal creation unit 20*d* creates the filtering control signal Sf from the basic control signal S and the notch filter F according to the operation amount of the turning operation tool 21 and the like. Further, the filtering control signal creation unit 20*d* creates the filtering control signal Sf on the basis of the basic control signal S and the notch filter F according to the operation amount of the telescopic operation tool 22 and the like. The filtering control signal creation unit 20*d* creates the filtering control signal Sf on the basis of the basic control signal S and the notch filter F corresponding to the operation amount of the derricking operation tool 23 and the like. Further, the filtering control signal creation unit 20*d* generates the filtering control signal Sf on the basis of the basic control signal S and the notch filter F according to the operation amount of the winding operation tool 24 and the like.

With such a configuration, the control device 20 controls the various valves 31 to 34 on the basis of the filtering control signal Sf. As a result, the control device 20 controls each actuator (51, 52, 53, 54) on the basis of the filtering control signal Sf.

Figure 4:
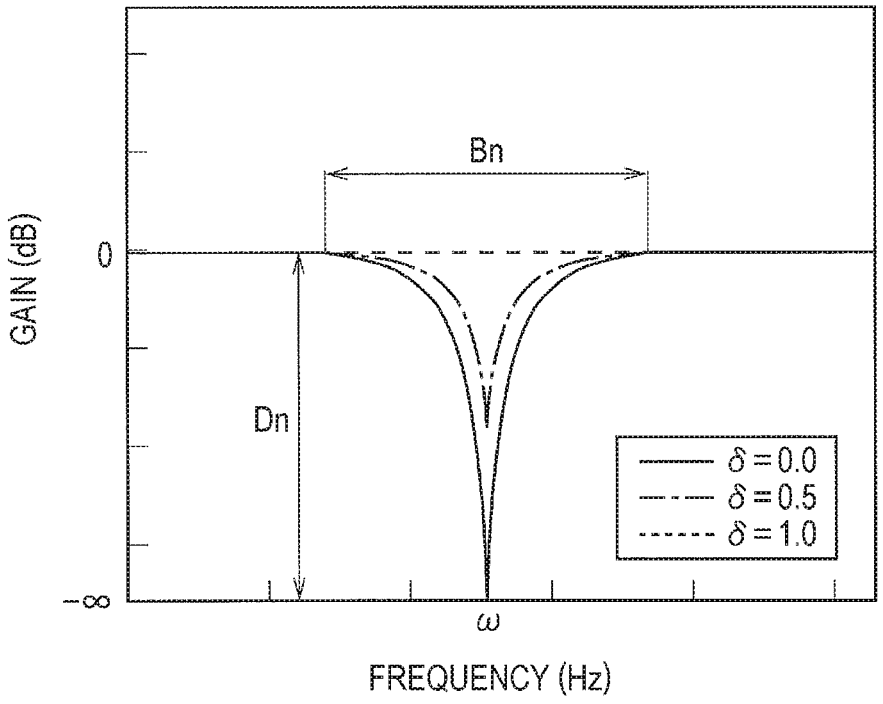
FIG. 4 is a diagram illustrating frequency characteristics of a notch filter.

Next, the notch filter F and the filtering control signal Sf will be described with reference to FIGS. 4 and 5.

The notch filter F has a characteristic that the attenuation rate increases as it approaches the resonance frequency ω in an arbitrary range centered on the resonance frequency ω. An arbitrary range centered on the resonance frequency ω is represented as a notch width Bn. The difference of the attenuation amount in the notch width Bn is represented as a notch depth Dn.

Therefore, the notch filter F is specified by the resonance frequency G, the notch width Bn, and the notch depth Dn. The notch depth Dn is determined on the basis of the notch depth coefficient δ. Therefore, when the notch depth coefficient δ=0, the gain characteristic at the resonance frequency ω is −∞ dB, and when the notch depth coefficient δ=1, the gain characteristic at the resonance frequency ω is 0 dB.

The filtering control signal Sf is a speed command transmitted to each actuator (51, 52, 53, 54). The filtering control signal Sf corresponding to the acceleration of the boom 7 or the like has a characteristic that the acceleration is gentler than the basic control signal S, and temporarily causes deceleration and then causes acceleration again (see part X in FIG. 5).

Here, the reason for temporarily decelerating is to suppress the swing of the load W during acceleration. Further, the filtering control signal Sf corresponding to deceleration of the boom 7 or the like has a characteristic that the deceleration is gentler or similar to that of the basic control signal S, and temporarily causes acceleration and then causes deceleration again (See part Y in FIG. 5). Here, the reason for temporarily accelerating is to suppress the swing of the load W during deceleration.

Figure 6:
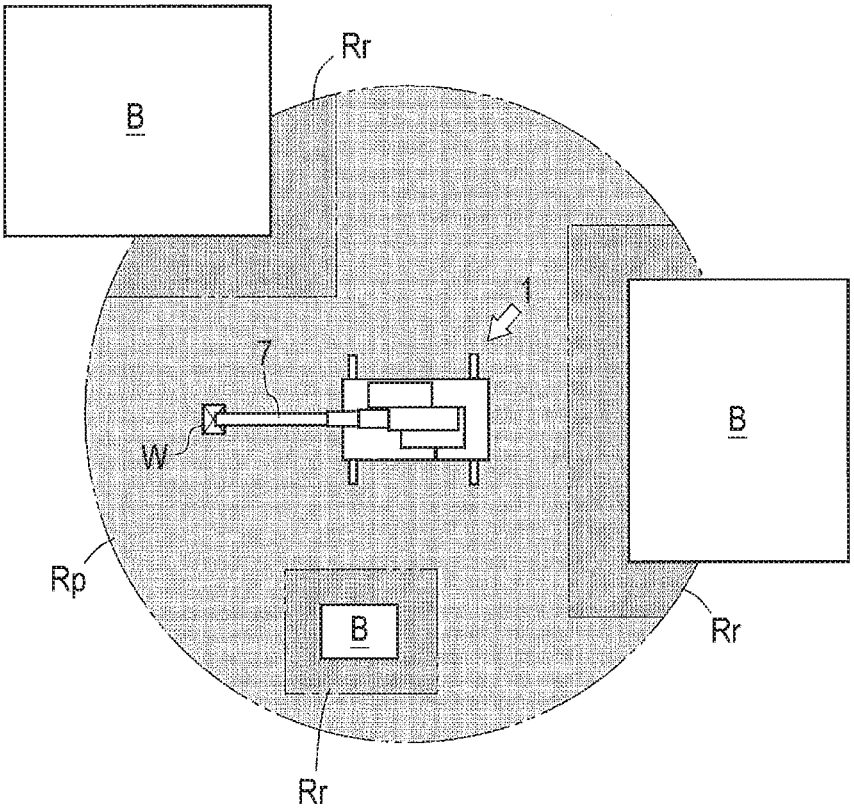
FIG. 6 is a diagram illustrating a transport allowable region and a transport restricted region at a work site.

Next, a transport allowable region Rp and a transport restricted region Rr at the work site will be described with reference to FIG. 6.

The transport allowable region Rp represents a region where the transport of the load W is permitted. In the transport allowable region Rp, the boom 7 is also allowed to move. Further, in the transport allowable region Rp, the notch depth coefficient δ is selectable within the range of 0 to 1.

When the notch depth coefficient δ is 0 or a numerical value close to 0, a slow reaction to the operation of the operator occurs, and the swing of the load W can be suppressed. On the other hand, when the notch depth coefficient δ is 1 or a numerical value close to 1, an agile reaction to the operation of the operator occurs, and it becomes possible to match the operation feeling of the operator.

The transport restricted region Rr represents a region where transport of the load W is not permitted. In the transport restricted region Rr, the boom 7 is not allowed to move (enter). In addition, since the load W and the boom 7 do not enter in the transport restricted region Rr, the notch depth coefficient δ and the like cannot be determined.

Further, the transport restricted region Rr is provided so as to surround an obstacle B and the like. Therefore, it is possible to prevent the load W and the boom 7 from colliding with the obstacle B or the like. In addition, when the load W or the boom 7 in the transport allowable region Rp is moving toward the transport restricted region Rr, the transport operation is automatically stopped.

Figure 7:
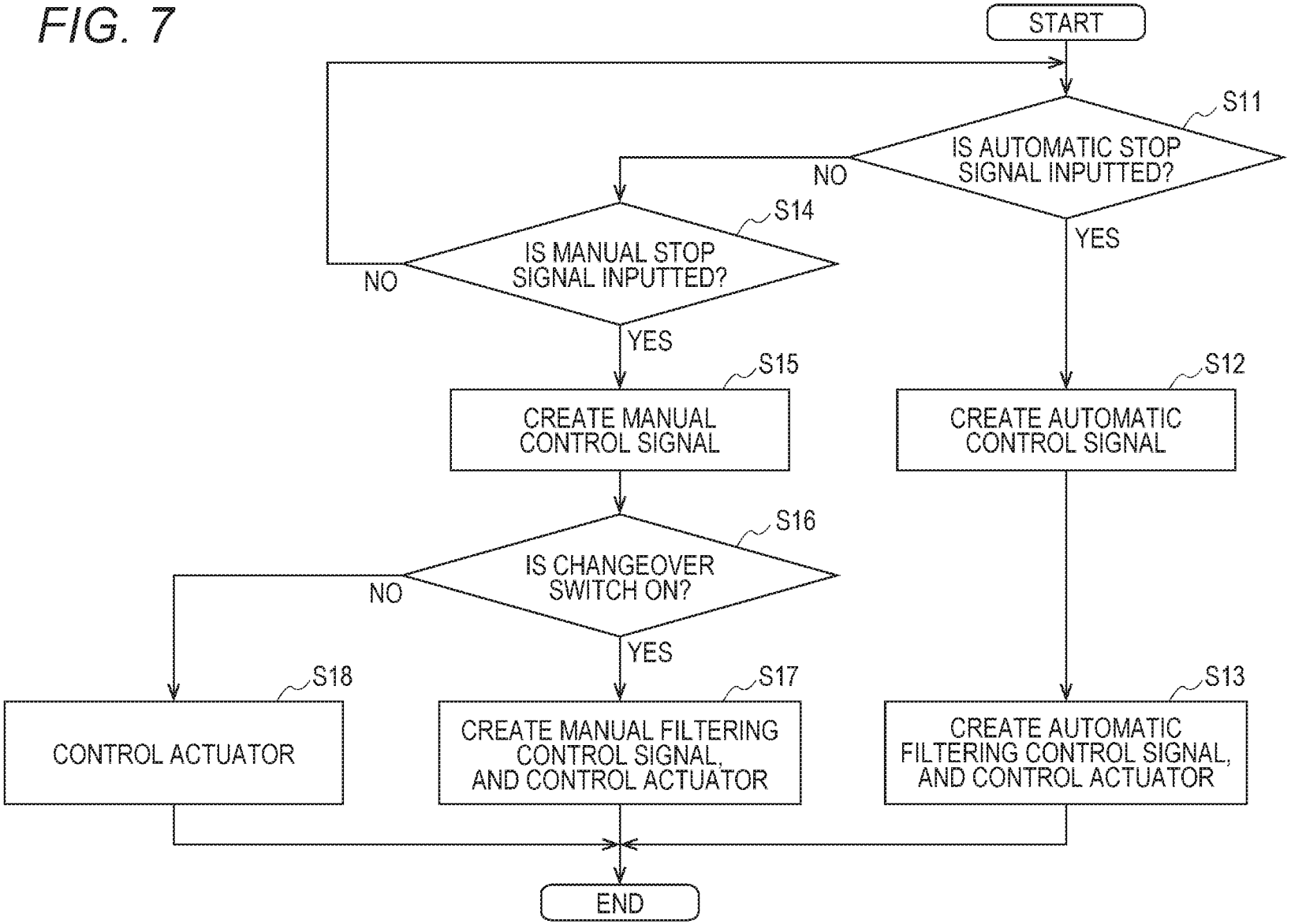
FIG. 7 is a diagram illustrating a control mode for automatically stopping or manually stopping the turning operation of a boom.

Hereinafter, a control mode for automatically stopping or manually stopping the transport operation of the load W will be described with reference to FIG. 7.

First, an example in which the load W is moving toward the transport restricted region Rr due to the turning operation of the boom 7 will be described. Here, the description will be given with reference to FIGS. 8 and 9 together with FIG. 7. In this example, the boom 7 corresponds to an example of the operable functional unit.

In step S11, the control device 20 determines whether the automatic stop signal has been input. The automatic stop signal is created when the load W or the boom 7 approaches the transport restricted region Rr. When the automatic stop signal is input ("YES" in step S11), the control process proceeds to step S12, and when the automatic stop signal is not input ("NO" in step S11), the control process proceeds to step S14.

Figure 8:
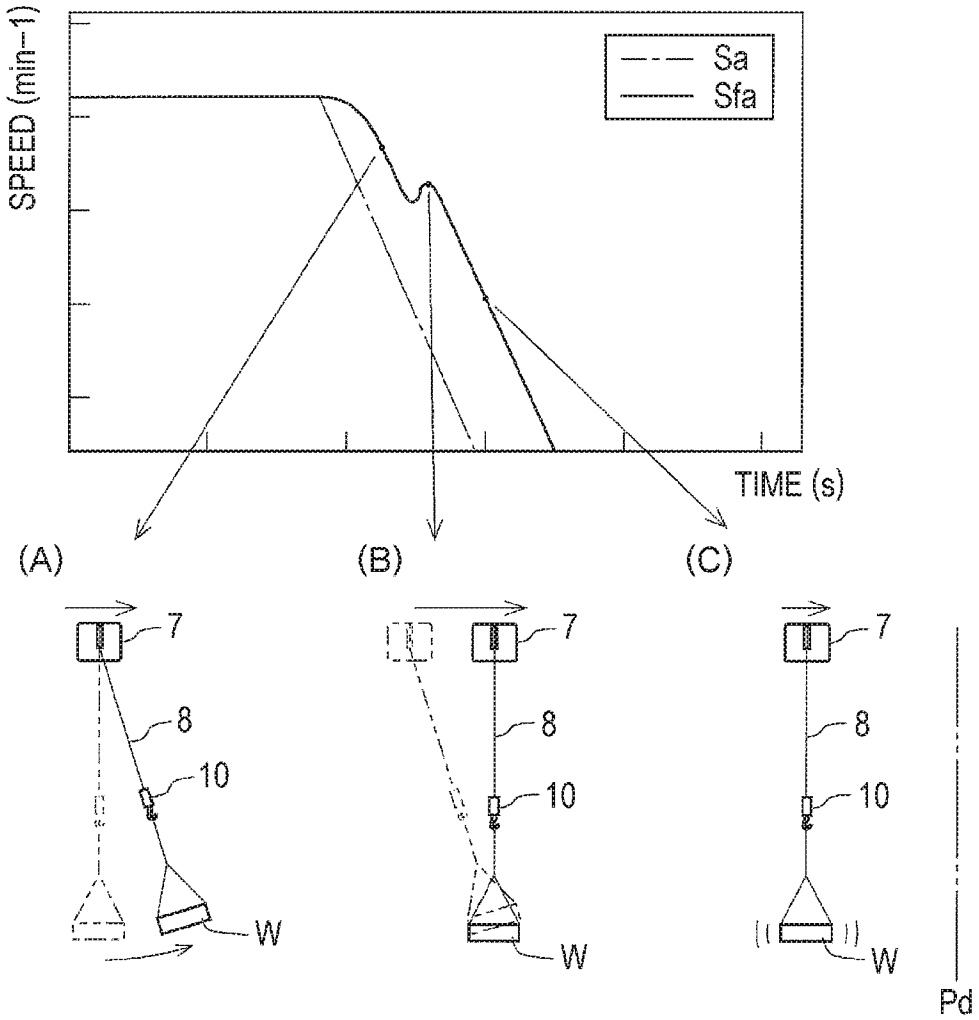
FIG. 8 is a diagram illustrating a movement of a load when the turning operation of the boom is automatically stopped.

In step S12, the control device 20 creates an automatic control signal Sa for the turning hydraulic motor 51 (see FIG. 8). The automatic control signal Sa is the basic control signal S created at the time of automatic stop. The automatic control signal Sa corresponds to an example of the third control signal. The automatic control signal Sa is created on the basis of the turning speed of the boom 7, the weight of the load W, and the like. The automatic control signal Sa is created on the basis of the program used at the time of automatic stop. The program is stored in the control device 20 in advance. In the control device 20, the part that generates the automatic control signal Sa may be regarded as an example of a second generation unit.

In step S13, the control device 20 creates a filtering control signal Sf (hereinafter referred to as "automatic filtering control signal Sfa") by applying the notch filter F to the automatic control signal Sa (third control signal) (see FIG. 8). The notch filter F at this time is created on the basis of the notch depth coefficient 5 that is arbitrarily set. The automatic filtering control signal Sfa corresponds to an example of the fourth control signal.

Then, the control device 20 controls the turning hydraulic motor 51 on the basis of the automatic filtering control signal Sfa. As a result, for example, it is possible to realize the control content that gives priority to suppressing the swing of the load W. In this case, when the turning speed of the boom 7 is reduced, the load W starts to swing due to inertia (see (A) in FIG. 8).

Therefore, the turning speed of the boom 7 is temporarily increased to catch up with the boom 7 and suppress the swing of the load W (see (B) in FIG. 8). Thereafter, the turning speed is decelerated again while the swing of the load W is suppressed (see (C) in FIG. 8). Further, the notch depth coefficient δ of the notch filter F is freely changed by an adjustment dial 26 described later.

In addition, the flow rate of the load W and the boom 7 (the moving distance from when the turning operation is stopped until the turning operation is stopped) is determined to be within an allowable flow rate Pd. The operator can arbitrarily set the allowable flow rate Pd.

By the way, in step S14, the control device 20 determines whether a manual stop signal is input. The manual stop signal is created when the operator operates the turning operation tool 21 to stop the turning operation of the boom 7. When the manual stop signal is input ("YES" in step S14), the control process proceeds to step S15, and when the manual stop signal is not input ("NO" in step S14), the control process returns to step S11.

Figure 9:
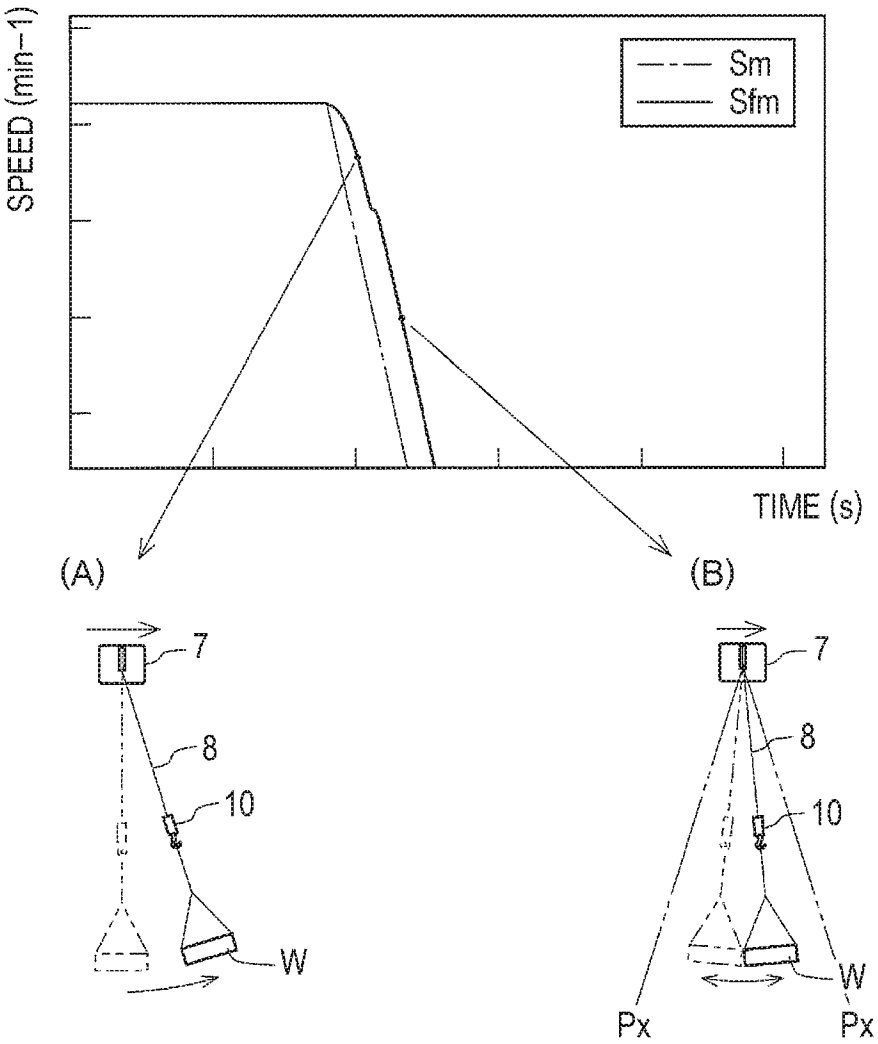
FIG. 9 is a diagram illustrating a movement of the load when the turning operation of the boom is manually stopped.

In step S15, the control device 20 creates a manual control signal Sm for the turning hydraulic motor 51 (see FIG. 9). The manual control signal Sm indicates the basic control signal S created at the time of manual stop. The manual control signal Sm is created on the basis of the operation amount and the operation speed of the turning operation tool 21 by the operator.

Further, the manual control signal Sm is created on the basis of a program used when manually stopping. The program is stored in the control device 20 in advance.

In step S16, the control device 20 determines whether the changeover switch 25 is "ON" or "OFF". The changeover switch 25 can be freely changed by the operator. When the changeover switch 25 is "ON" ("YES" in step S16), the control process proceeds to step S17, and when the changeover switch 25 is "OFF" ("NO" in step S16), the control process proceeds to step S18.

Further, the state in which the changeover switch 25 is "OFF" is defined as the first state of the changeover switch 25. On the other hand, the state in which the changeover switch 25 is "ON" is defined as the second state of the changeover switch 25. The changeover switch 25 corresponds to an example of a switch unit.

In step S17, the control device 20 applies the notch filter F to the manual control signal Sm to create the filtering control signal Sf (hereinafter, referred to as "manual filtering control signal Sfm") (see FIG. 9). The notch filter F at this time is also created on the basis of the notch depth coefficient δ that is arbitrarily set.

The notch filter F used in step S13 and the notch filter F used in step S17 may be the same filter or different filters. As an example, by the notch filter F used in step S17, the ratio of frequency components attenuated from the manual control signal Sm may be smaller than the ratio of frequency components attenuated from the automatic control signal Sa by the notch filter F used in step S13. In other words, the ratio of frequency components attenuated from the manual control signal Sm when the actuator is controlled by manual control (the case of step S17) may be smaller than the ratio of frequency components attenuated from the automatic control signal Sa when the actuator is controlled by automatic control (the case of step S13).

Then, the control device 20 controls the turning hydraulic motor 51 on the basis of the manual filtering control signal Sfm. As a result, it is possible to realize the control content that gives priority to matching with the operation feeling of the operator rather than suppressing the swing of the load W, for example.

In this case, when the turning speed of the boom 7 is reduced, the load W starts to swing due to inertia (see (A) in FIG. 9). Then, while the turning speed of the boom 7 is slightly increased or is not increased, the turning speed of the boom 7 is decelerated as it is (see (B) in FIG. 9).

The notch depth coefficient δ of the notch filter F is freely changed by an adjustment dial 27 described later. In addition, the swing amount of the load W is determined to be within an allowable swing width Px. The operator can arbitrarily set the allowable swing width Px.

On the other hand, in step S18, the control device 20 controls the turning hydraulic motor 51 on the basis of the manual control signal Sm. That is, the control device 20 controls the turning hydraulic motor 51 on the basis of the manual control signal Sm as it is, without creating the manual filtering control signal Sfm.

As a result, it is possible to realize the control content that gives the highest priority to matching the operation feeling of the operator without considering the swing of the load W. In this case, in order to suppress the swing of the load W, it is necessary for the operator to operate the turning operation tool 21 to temporarily increase the turning speed of the boom 7 and make the load W, which has started to swing, catch up with the boom 7. Such an operation can be performed by a skilled operator.

As described above, the crane 1 is provided with the actuator (the turning hydraulic motor 51) used for carrying the load W, the control device 20 for instructing the operating state of the actuator 51, and a switch (the changeover switch 25) which is connected to the control device 20 to switch the control mode of the actuator 51.

Then, when the switch 25 selects one (when the switch 25 is in the OFF state and the first state of the switch), the control device 20 controls the actuator 51 on the basis of the basic control signal S (manual control signal Sm) of the actuator 51 to stop the transport operation.

Further, when the switch 25 selects the other (when the switch 25 is in the ON state and the second state of the switch), the control device 20 applies the notch filter F to the basic control signal Sm of the actuator 51 to create the filtering control signal Sf (manual filtering control signal Sfm). Then, the control device 20 controls the actuator 51 on the basis of the created filtering control signal Sfm to stop the transport operation. According to such a crane 1, the operation characteristics can be selected for the control mode when the transport operation of the load W is stopped.

Specifically, in the crane 1, the actuator (the turning hydraulic motor 51) is a hydraulic motor that turns the boom 7. When the switch (changeover switch 25) selects one (the changeover switch 25 is in the OFF state), the control device 20 controls the hydraulic motor 51 on the basis of the basic control signal S (manual control signal Sm) of the hydraulic motor 51 to stop the turning operation.

When the switch 25 selects the other (the changeover switch 25 is in the ON state), the control device 20 applies the notch filter F to the basic control signal Sm of the hydraulic motor 51 to create the filtering control signal Sf (manual filtering control signal Sfm). Then, the control device 20 controls the hydraulic motor 51 on the basis of the created filtering control signal Sfm to stop the turning operation. According to such a crane 1, the operation characteristics can be selected for the control mode when the turning operation of the boom 7 is stopped.

In the crane 1, the swing frequency of the load W is set to the resonance frequency G in order to suppress the swing of the load W caused by the turning operation of the boom 7. However, in order to suppress the swing of the boom 7 itself caused by the turning operation of the boom 7, the swing frequency of the boom 7 may be set to the resonance frequency ω. Further, the resonance frequency ω may be set in consideration of both the swing frequency of the load W and the swing frequency of the boom 7.

In addition, in the crane 1, the operator operates the changeover switch 25 to select the control mode, but the invention is not limited thereto. For example, the changeover switch 25 may be incorporated in an arithmetic device of the control device 20 and may be configured in advance so as to select a desired control mode.

Alternatively, the configuration may be such that an appropriate control mode is automatically selected according to the situation. That is, the changeover switch 25 is not limited to being manually operated.

Next, an example in which the load W is moving toward the transport restricted region Rr due to the telescopic operation of the boom 7 will be described. Here, the description will be given with reference to FIGS. 10 and 11 together with FIG. 7. Although the telescopic operation of the boom 7 is described as an extension operation, the same applies to a contraction operation. In this example, the boom 7 corresponds to an example of the operable functional unit.

In step S11, the control device 20 determines whether the automatic stop signal has been input. The automatic stop signal is created when the load W or the boom 7 approaches the transport restricted region Rr. When the automatic stop signal is input ("YES" in step S11), the control process proceeds to step S12, and when the automatic stop signal is not input ("NO" in step S11), the control process proceeds to step S14.

Figure 10:
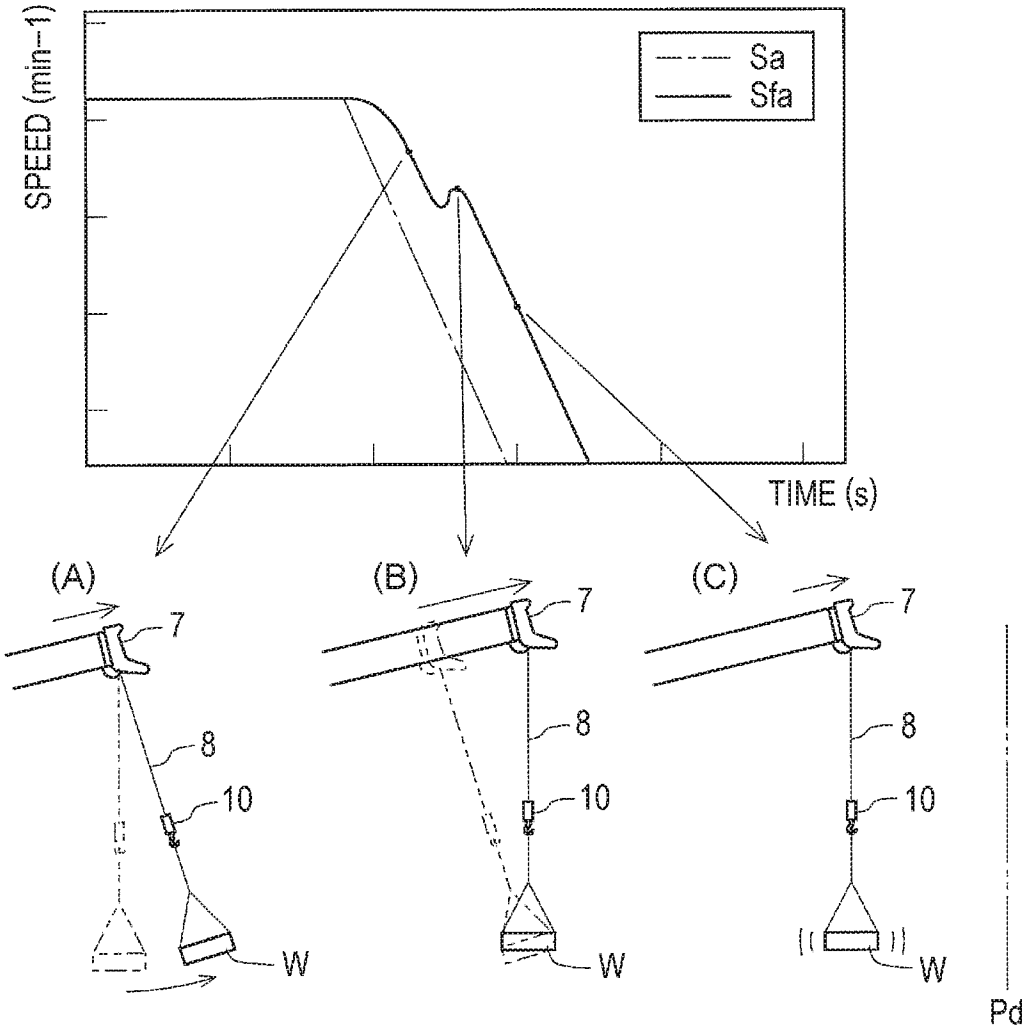
FIG. 10 is a diagram illustrating a movement of the load when a telescopic operation of the boom is automatically stopped.

In step S12, the control device 20 creates the automatic control signal Sa for the telescopic hydraulic cylinder 52 (see FIG. 10). The automatic control signal Sa is the basic control signal S created at the time of automatic stop. The automatic control signal Sa is created on the basis of the extension speed of the boom 7, the weight of the load W, and the like.

The automatic control signal Sa is created on the basis of the program used at the time of automatic stop. The program is stored in the control device 20 in advance.

In step S13, the control device 20 applies the notch filter F to the automatic control signal Sa to create the filtering control signal Sf (hereinafter, referred to as "automatic filtering control signal Sfa") (see FIG. 10). The notch filter F at this time is created on the basis of the notch depth coefficient δ that is arbitrarily set.

Then, the control device 20 controls the telescopic hydraulic cylinder 52 on the basis of the automatic filtering control signal Sfa. As a result, for example, it is possible to realize the control content that gives priority to suppressing the swing of the load W. In this case, when the extension speed of the boom 7 is reduced, the load W starts to swing due to inertia (see (A) in FIG. 10).

Therefore, the extension speed of the boom 7 is temporarily increased to catch up with the boom 7 and suppress the swing of the load W (see (B) in FIG. 10). Thereafter, the load W is decelerated again while the swing is suppressed (see (C) in FIG. 10).

Further, the notch depth coefficient δ of the notch filter F is freely changed by the adjustment dial 26 described later. In addition, the flow rate of the load W and the boom 7 (the moving distance from when the turning operation is stopped until the extension operation is stopped) is determined to be within an allowable flow rate Pd. The operator can arbitrarily set the allowable flow rate Pd.

By the way, in step S14, the control device 20 determines whether the manual stop signal is input. The manual stop signal is created when the operator operates the telescopic operation tool 22 to stop the extension operation of the boom 7. When the manual stop signal is input ("YES" in step S14), the control process proceeds to step S15, and when the manual stop signal is not input ("NO" in step S14), the control process returns to step S11.

Figure 11:
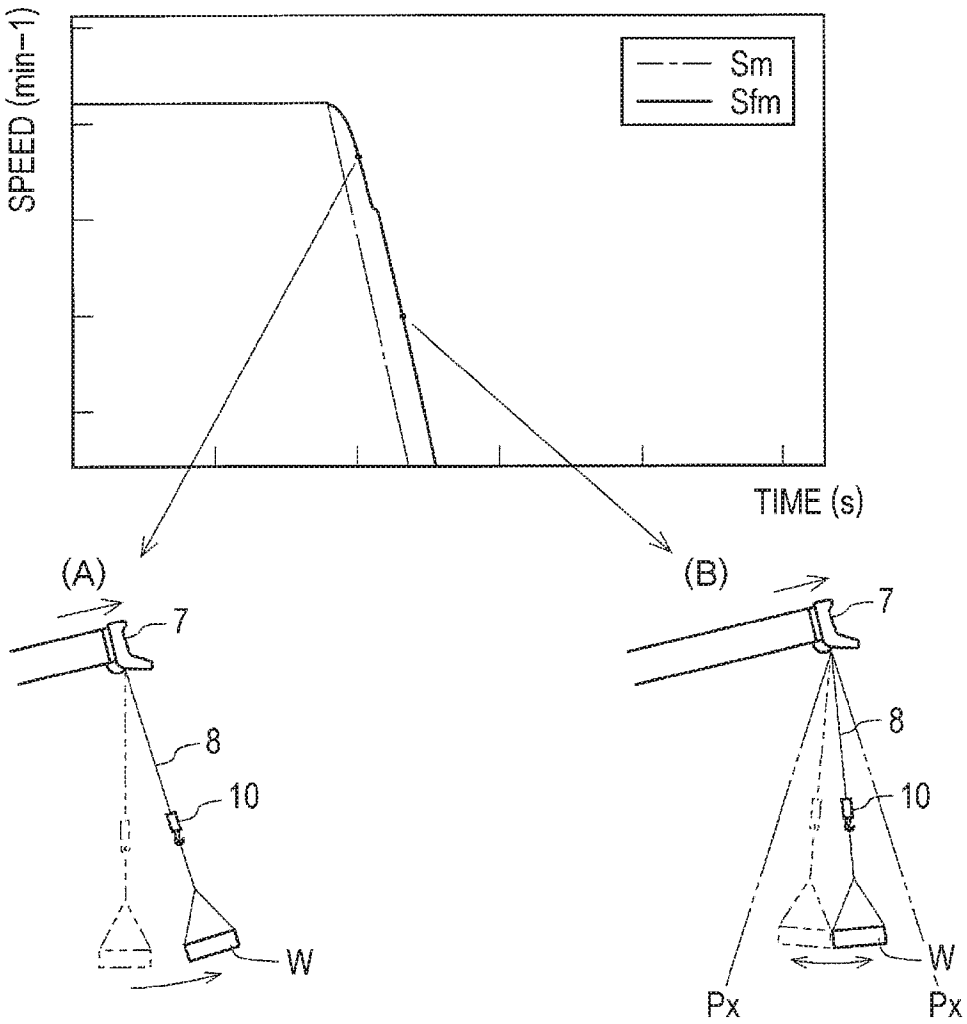
FIG. 11 is a diagram illustrating a movement of the load when the telescopic operation of the boom is manually stopped.

In step S15, the control device 20 creates the manual control signal Sm for the telescopic hydraulic cylinder 52 (see FIG. 11). The manual control signal Sm is the basic control signal S created at the time of manual stop. The manual control signal Sm is created on the basis of the operation amount and the operation speed of the telescopic operation tool 22 by the operator.

Further, the manual control signal Sm is created on the basis of a program used when manually stopping. The program is stored in the control device 20 in advance.

In step S16, the control device 20 determines whether the changeover switch 25 is "ON" or "OFF". The changeover switch 25 can be freely changed by the operator. When the changeover switch 25 is "ON" ("YES" in step S16), the control process proceeds to step S17, and when the changeover switch 25 is "OFF" ("NO" in step S16), the control process proceeds to step S18.

In step S17, the control device 20 applies the notch filter F to the manual control signal Sm to create the filtering control signal Sf (hereinafter referred to as "manual filtering control signal Sfm") (see FIG. 11). The notch filter F at this time is also created on the basis of the notch depth coefficient δ that is arbitrarily set.

Then, the control device 20 controls the telescopic hydraulic cylinder 52 on the basis of the manual filtering control signal Sfm. As a result, it is possible to realize the control content that gives priority to matching with the operation feeling of the operator rather than suppressing the swing of the load W, for example.

In this case, when the extension speed of the boom 7 is reduced, the load W starts to swing due to inertia (see (A) in FIG. 11). Then, while the extension speed of the boom 7 is slightly increased or is not increased, the extension speed of the boom 7 is decelerated as it is (see (B) in FIG. 11).

The notch depth coefficient δ of the notch filter F is freely changed by the adjustment dial 27 described later. In addition, the swing amount of the load W is determined to be within the allowable swing width Px. The operator can arbitrarily set the allowable swing width Px.

On the other hand, in step S18, the control device 20 controls the telescopic hydraulic cylinder 52 on the basis of the manual control signal Sm. That is, the control device 20 controls the telescopic hydraulic cylinder 52 on the basis of the manual control signal Sm as it is, without creating the manual filtering control signal Sfm. As a result, it is possible to realize the control content that gives the highest priority to matching the operation feeling of the operator without considering the swing of the load W.

In this case, in order to suppress the swing of the load W, it is necessary for the operator to operate the telescopic operation tool 22 to temporarily increase the extension speed of the boom 7 and make the load W, which has started to swing, catch up with the boom 7. Such an operation can be performed by a skilled operator.

As described above, the crane 1 is provided with the actuator (the telescopic hydraulic cylinder 52) used for carrying the load W, the control device 20 for instructing the operating state of the actuator 52, and a switch (the changeover switch 25) which is connected to the control device 20 to switch the control mode of the actuator 52.

Then, when the switch 25 selects one, the control device 20 controls the actuator 52 on the basis of the basic control signal S (manual control signal Sm) of the actuator 52 to stop the transport operation.

Further, when the switch 25 selects the other, the control device 20 applies the notch filter F to the basic control signal Sm of the actuator 52 to create the filtering control signal Sf (manual filtering control signal Sfm), and controls the actuator 52 on the basis of the filtering control signal Sfm to stop the transport operation. According to the crane 1, the operation characteristics can be selected for the control mode when the transport operation of the load W is stopped.

More specifically, in the crane 1, the actuator (the telescopic hydraulic cylinder 52) is a hydraulic cylinder that expands and contracts the boom 7. When the switch (the changeover switch 25) selects one, the control device 20 controls the hydraulic cylinder 52 on the basis of the basic control signal S (manual control signal Sm) of the hydraulic cylinder 52 to stop the telescopic operation.

Further, when the switch 25 selects the other, the control device 20 applies the notch filter F to the basic control signal Sm of the hydraulic cylinder 52 to create the filtering control signal Sf (manual filtering control signal Sfm), and controls the hydraulic cylinder 52 on the basis of the filtering control signal Sfm to stop the telescopic operation. According to such a crane 1, the operation characteristics can be selected for the control mode when the telescopic operation of the boom 7 is stopped.

In the crane 1, the swing frequency of the load W is set to the resonance frequency ω in order to suppress the swing of the load W caused by the telescopic operation of the boom 7. However, in order to suppress the swing of the boom 7 itself caused by the telescopic operation of the boom 7, the swing frequency of the boom 7 may be set to the resonance frequency ω. Further, the resonance frequency ω may be set in consideration of both the swing frequency of the load W and the swing frequency of the boom 7.

In addition, in the crane 1, the operator operates the changeover switch 25 to select the control mode, but the invention is not limited thereto. For example, the changeover switch 25 may be incorporated in the arithmetic device of the control device 20 and may be configured in advance so as to select a desired control mode. Alternatively, the configuration may be such that an appropriate control mode is automatically selected according to the situation. That is, the changeover switch 25 is not limited to being manually operated.

Next, an example in which the load W is moving toward the transport restricted region Rr due to the derricking operation of the boom 7 will be described. Here, the description will be given with reference to FIGS. 12 and 13 together with FIG. 7. In addition, the derricking operation of the boom 7 will be described as the raising operation, but the same applies to the lowering operation. In this example, the boom 7 corresponds to an example of the operable functional unit.

In step S11, the control device 20 determines whether the automatic stop signal has been input. The automatic stop signal is created when the load W or the boom 7 approaches the transport restricted region Rr. When the automatic stop signal is input ("YES" in step S11), the control process proceeds to step S12, and when the automatic stop signal is not input ("NO" in step S11), the control process proceeds to step S14.

Figure 12:
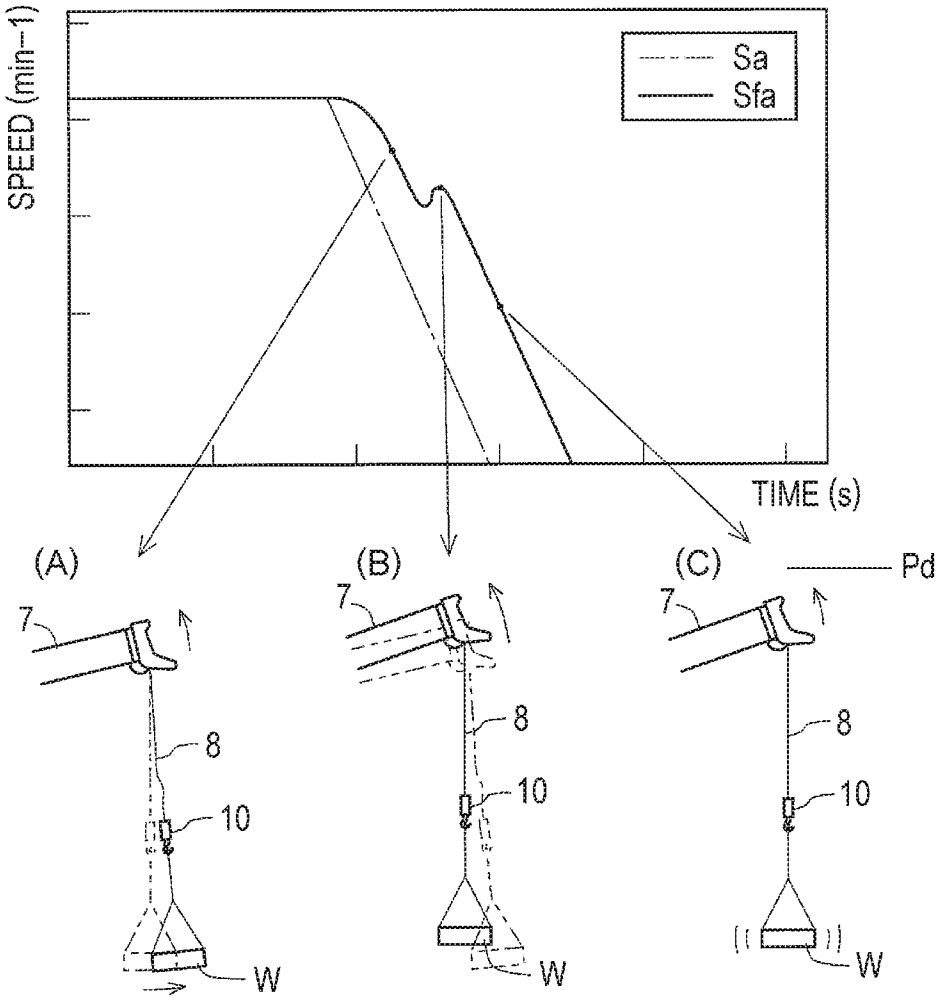
FIG. 12 is a diagram illustrating a movement of the load when a derricking operation of the boom is automatically stopped.

In step S12, the control device 20 creates the automatic control signal Sa for the derricking hydraulic cylinder 53 (see FIG. 12). The automatic control signal Sa is the basic control signal S created at the time of automatic stop.

The automatic control signal Sa is created on the basis of the rising speed of the boom 7, the weight of the load W, and the like. The automatic control signal Sa is created on the basis of the program used at the time of automatic stop. The program is stored in the control device 20 in advance.

In step S13, the control device 20 applies the notch filter F to the automatic control signal Sa to create the filtering control signal Sf (hereinafter, referred to as "automatic filtering control signal Sfa") (see FIG. 12). The notch filter F at this time is created on the basis of the notch depth coefficient δ that is arbitrarily set.

Then, the control device 20 controls the derricking hydraulic cylinder 53 on the basis of the automatic filtering control signal Sfa. As a result, for example, it is possible to realize the control content that gives priority to suppressing the swing of the load W. In this case, when the rising speed of the boom 7 is reduced, the load W starts to swing due to inertia (starts to swing due to the bending of the wire rope 8: see (A) in FIG. 12).

Therefore, the rising speed of the boom 7 is temporarily increased to stretch the wire rope 8, so that the swing of the load W is suppressed (see (B) in FIG. 12). Thereafter, the load W is decelerated again while the swing is suppressed (see (C) in FIG. 12).

Further, the notch depth coefficient δ of the notch filter F is freely changed by the adjustment dial 26 described later. In addition, the flow rate of the load W and the boom 7 (the moving distance from when the turning operation is stopped until the raising operation is stopped) is determined to be within an allowable flow rate Pd. The operator can arbitrarily set the allowable flow rate Pd.

By the way, in step S14, the control device 20 determines whether the manual stop signal is input. The manual stop signal is created when the operator operates the derricking operation tool 23 to stop the raising operation of the boom 7. When the manual stop signal is input ("YES" in step S14), the control process proceeds to step S15, and when the manual stop signal is not input ("NO" in step S14), the control process returns to step S11.

Figure 13:
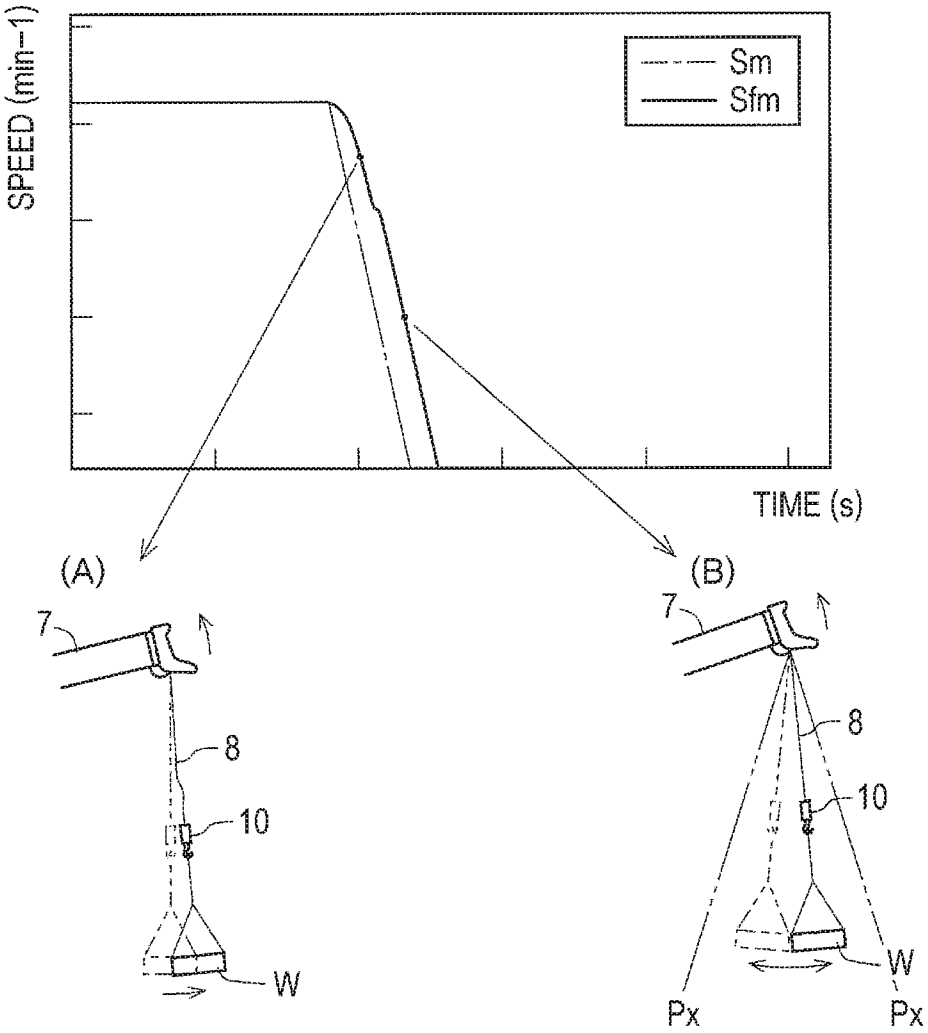
FIG. 13 is a diagram illustrating a movement of the load when the derricking operation of the boom is manually stopped.

In step S15, the control device 20 creates the manual control signal Sm for the derricking hydraulic cylinder 53 (see FIG. 13). The manual control signal Sm is the basic control signal S created at the time of manual stop. The manual control signal Sm is created on the basis of the operation amount and the operation speed of the derricking operation tool 23 by the operator. Further, the manual control signal Sm is created on the basis of a program used when manually stopping. The program is stored in the control device 20 in advance.

In step S16, the control device 20 determines whether the changeover switch 25 is "ON" or "OFF". The changeover switch 25 can be freely changed by the operator. When the changeover switch 25 is "ON" ("YES" in step S16), the control process proceeds to step S17, and when the changeover switch 25 is "OFF" ("NO" in step S16), the control process proceeds to step S18.

In step S17, the control device 20 applies the notch filter F to the manual control signal Sm to create the filtering control signal Sf (hereinafter referred to as "manual filtering control signal Sfm") (see FIG. 13). The notch filter F at this time is also created on the basis of the notch depth coefficient δ that is arbitrarily set.

Then, the control device 20 controls the derricking hydraulic cylinder 53 on the basis of the manual filtering control signal Sfm. As a result, it is possible to realize the control content that gives priority to matching with the operation feeling of the operator rather than suppressing the swing of the load W, for example.

In this case, when the rising speed of the boom 7 is reduced, the load W starts to swing due to inertia (starts to swing due to the bending of the wire rope 8: see (A) in FIG. 13). Then, while the rising speed of the boom 7 is slightly increased or is not increased, the rising speed of the boom 7 is decelerated as it is (see (B) in FIG. 13). The notch depth coefficient δ of the notch filter F is freely changed by the adjustment dial 27 described later. In addition, the swing amount of the load W is determined to be within the allowable swing width Px. The operator can arbitrarily set the allowable swing width Px.

On the other hand, in step S18, the control device 20 controls the derricking hydraulic cylinder 53 on the basis of the manual control signal Sm. That is, the control device 20 controls the derricking hydraulic cylinder 53 on the basis of the manual control signal Sm as it is, without creating the manual filtering control signal Sfm.

As a result, it is possible to realize the control content that gives the highest priority to matching the operation feeling of the operator without considering the swing of the load W. In this case, in order to suppress the swing of the load W, it is necessary for the operator to operate the derricking operation tool 23 to temporarily increase the rising speed of the boom 7 and stretch the wire rope 8 which has started to bend. Such an operation can be performed by a skilled operator.

As described above, the crane 1 is provided with the actuator (the derricking hydraulic cylinder 53) used for carrying the load W, the control device 20 for instructing the operating state of the actuator 53, and a switch (the changeover switch 25) which is connected to the control device 20 to switch the control mode of the actuator 53.

Then, when the switch 25 selects one, the control device 20 controls the actuator 53 on the basis of the basic control signal S (manual control signal Sm) of the actuator 53 to stop the transport operation.

Further, when the switch 25 selects the other, the control device 20 applies the notch filter F to the basic control signal Sm of the actuator 53 to create the filtering control signal Sf (manual filtering control signal Sfm), and controls the actuator 53 on the basis of the filtering control signal Sfm to stop the transport operation. According to such a crane 1, the operation characteristics can be selected for the control mode when the transport operation of the load W is stopped.

More specifically, in the crane 1, the actuator (the derricking hydraulic cylinder 53) is a hydraulic cylinder that raises the boom 7. When the switch (the changeover switch 25) selects one, the control device 20 controls the hydraulic cylinder 53 on the basis of the basic control signal S (manual control signal Sm) of the hydraulic cylinder 53 to stop the derricking operation.

Further, when the switch 25 selects the other, the control device 20 applies the notch filter F to the basic control signal Sm of the hydraulic cylinder 53 to create the filtering control signal Sf (manual filtering control signal Sfm), and controls the hydraulic cylinder 53 on the basis of the filtering control signal Sfm to stop the derricking operation. According to the crane 1, the operation characteristics can be selected for the control mode when the derricking operation of the boom 7 is stopped.

In the crane 1, the swing frequency of the load W is set to the resonance frequency ω in order to suppress the swing of the load W caused by the derricking operation of the boom 7. However, in order to suppress the swing of the boom 7 itself caused by the derricking operation of the boom 7, the swing frequency of the boom 7 may be set to the resonance frequency G. Further, the resonance frequency ω may be set in consideration of both the swing frequency of the load W and the swing frequency of the boom 7.

In addition, in the crane 1, the operator operates the changeover switch 25 to select the control mode, but the invention is not limited thereto. For example, the changeover switch 25 may be incorporated in the arithmetic device of the control device 20 and may be configured in advance so as to select a desired control mode. Alternatively, the configuration may be such that an appropriate control mode is automatically selected according to the situation. That is, the changeover switch 25 is not limited to being manually operated.

Next, an example in which the load W is moving toward the transport restricted region Rr due to the lifting operation of the hook 10 will be described. Here, the description will be given with reference to FIGS. 14 and 15 together with FIG. 7. Although the lifting operation of the hook 10 is described as an ascending operation, the same goes for the descending operation. In this example, the winch 9 for lifting the hook 10 corresponds to an example of the operable functional unit.

In step S11, the control device 20 determines whether the automatic stop signal has been input. The automatic stop signal is created when the load W or the boom 7 approaches the transport restricted region Rr. When the automatic stop signal is input, the process proceeds to step S12, and when the automatic stop signal is not input, the process proceeds to step S14.

Figure 14:
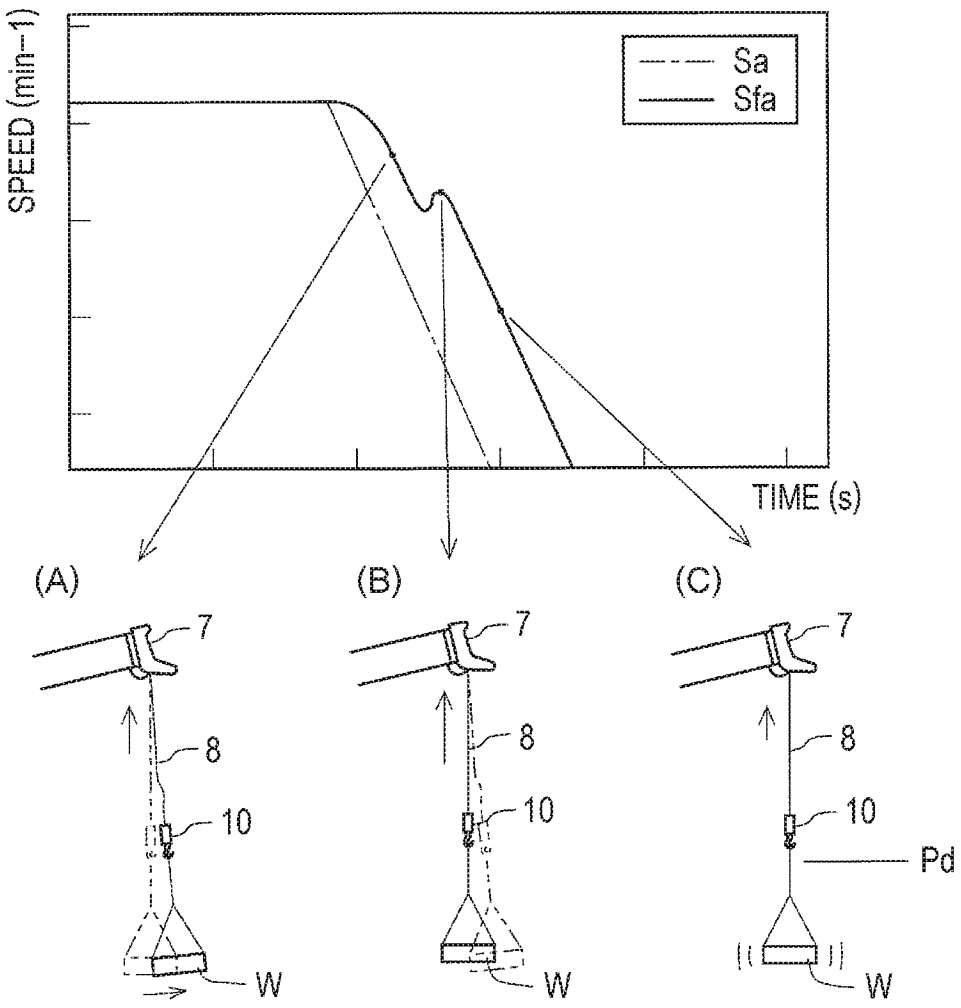
FIG. 14 is a diagram illustrating a movement of the load when a lifting operation of the hook is automatically stopped.

In step S12, the control device 20 creates an automatic control signal Sa for the winding hydraulic motor 54 (see FIG. 14). The automatic control signal Sa is the basic control signal S created at the time of automatic stop. The automatic control signal Sa is created on the basis of the ascending speed of the hook 10, the weight of the load W, and the like. The automatic control signal Sa is created on the basis of the program used at the time of automatic stop. The program is stored in the control device 20 in advance.

In step S13, the control device 20 applies the notch filter F to the automatic control signal Sa to create the filtering control signal Sf (hereinafter, referred to as "automatic filtering control signal Sfa") (see FIG. 14). The notch filter F at this time is created on the basis of the notch depth coefficient δ that is arbitrarily set.

Then, the control device 20 controls the winding hydraulic motor 54 on the basis of the automatic filtering control signal Sfa. As a result, for example, it is possible to realize the control content that gives priority to suppressing the swing of the load W. In this case, when the ascending speed of the hook 10 is reduced, the load W starts to swing due to inertia (starts to swing due to the bending of the wire rope 8: see (A) in FIG. 14).

Therefore, the ascending speed of the hook 10 is temporarily increased to stretch the wire rope 8, so that the swing of the load W is suppressed (see (B) in FIG. 14). Thereafter, the load W is decelerated again while the swing is suppressed (see (C) in FIG. 14).

Further, the notch depth coefficient δ of the notch filter F is freely changed by the adjustment dial 26 described later. In addition, the flow rate of the load W (the moving distance from when the turning operation is stopped until the ascending operation is stopped) is determined to be within an allowable flow rate Pd. The operator can arbitrarily set the allowable flow rate Pd.

By the way, in step S14, the control device 20 determines whether the manual stop signal is input. The manual stop signal is created when the operator operates the winding operation tool 24 to stop the ascending operation of the hook 10. When the manual stop signal is input ("YES" in step S14), the control process proceeds to step S15, and when the manual stop signal is not input ("NO" in step S14), the control process returns to step S11.

Figure 15:
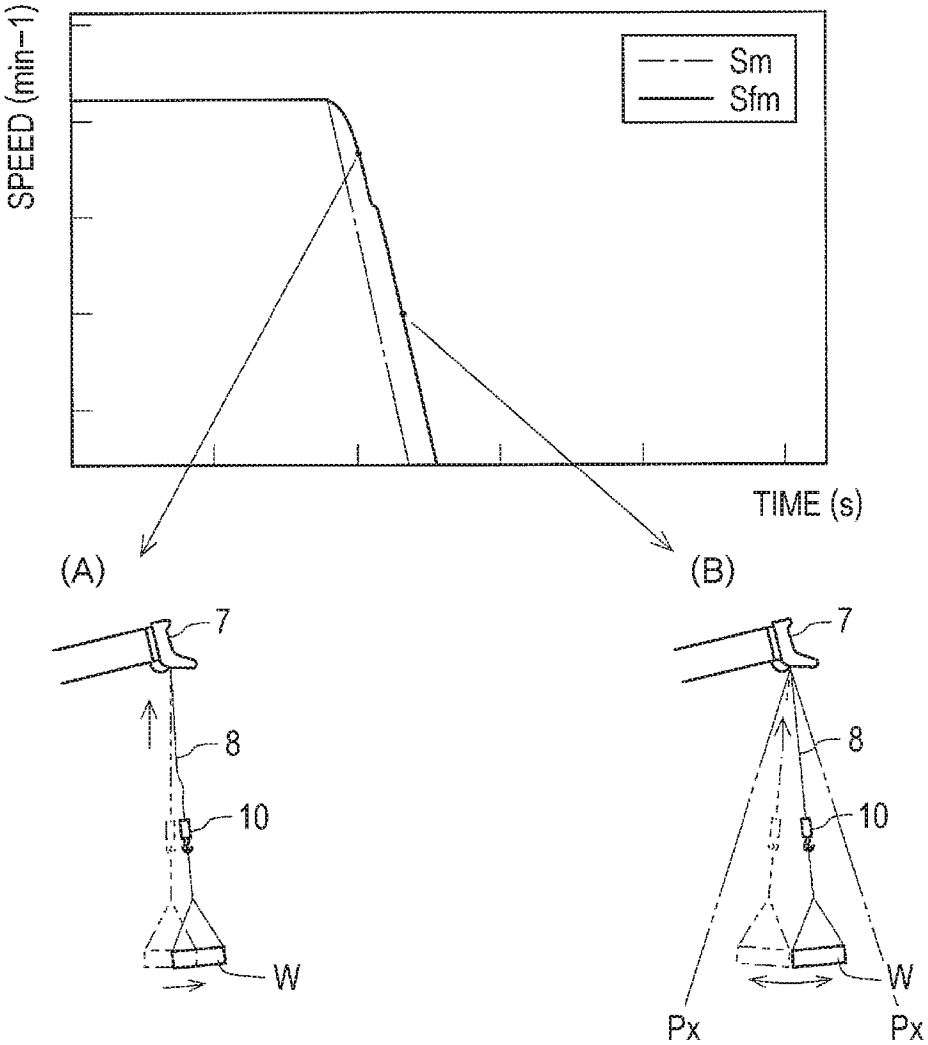
FIG. 15 is a diagram illustrating a movement of the load when the lifting operation of the hook is manually stopped.

In step S15, the control device 20 creates a manual control signal Sm for the winding hydraulic motor 54 (see FIG. 15). The manual control signal Sm is the basic control signal S created at the time of manual stop. The manual control signal Sm is created on the basis of the operation amount and the operation speed of the winding operation tool 24 by the operator. Further, the manual control signal Sm is created on the basis of a program used when manually stopping. The program is stored in the control device 20 in advance.

In step S16, the control device 20 determines whether the changeover switch 25 is "ON" or "OFF". The changeover switch 25 can be freely changed by the operator. When the changeover switch 25 is "ON" ("YES" in step S16), the control process proceeds to step S17, and when the changeover switch 25 is "OFF" ("NO" in step S16), the control process proceeds to step S18.

In step S17, the control device 20 applies the notch filter F to the manual control signal Sm to create the filtering control signal Sf (hereinafter referred to as "manual filtering control signal Sfm") (see FIG. 15). The notch filter F at this time is also created on the basis of the notch depth coefficient δ that is arbitrarily set. Then, the control device 20 controls the winding hydraulic motor 54 on the basis of the manual filtering control signal Sfm. As a result, it is possible to realize the control content that gives priority to matching with the operation feeling of the operator rather than suppressing the swing of the load W, for example.

In this case, when the ascending speed of the hook 10 is reduced, the load W starts to swing due to inertia (starts to swing due to the bending of the wire rope 8: see (A) in FIG. 15). Then, the ascending speed of the hook 10 is slightly increased or is not increased, the ascending speed of the hook 10 is decelerated as it is (see (B) in FIG. 15).

The notch depth coefficient δ of the notch filter F is freely changed by the adjustment dial 27 described later. In addition, the swing amount of the load W is determined to be within the allowable swing width Px. The operator can arbitrarily set the allowable swing width Px.

On the other hand, in step S18, the control device 20 controls the winding hydraulic motor 54 on the basis of the manual control signal Sm. That is, the control device 20 controls the winding hydraulic motor 54 on the basis of the manual control signal Sm as it is, without creating the manual filtering control signal Sfm.

As a result, it is possible to realize the control content that gives the highest priority to matching the operation feeling of the operator without considering the swing of the load W. In this case, in order to suppress the swing of the load W, it is necessary for the operator to operate the winding operation tool 24 to temporarily increase the ascending speed of the hook 10 and stretch the wire rope 8 which has started to bend. Such an operation can be performed by a skilled operator.

As described above, the crane 1 is provided with the actuator (the winding hydraulic motor 54) used for carrying the load W, the control device 20 for instructing the operating state of the actuator 54, and a switch (the changeover switch 25) which is connected to the control device 20 to switch the control mode of the actuator 54.

Then, when the switch 25 selects one, the control device 20 controls the actuator 54 on the basis of the basic control signal S (manual control signal Sm) of the actuator 54 to stop the transport operation. Further, when the switch 25 selects the other, the control device 20 applies the notch filter F to the basic control signal Sm of the actuator 54 to create the filtering control signal Sf (manual filtering control signal Sfm), and controls the actuator 54 on the basis of the filtering control signal Sfm to stop the transport operation. According to the crane 1, the operation characteristics can be arbitrarily adjusted for the control mode when the transport operation of the load W is manually stopped.

Specifically, in the crane 1, the actuator (the winding hydraulic motor 54) is a hydraulic motor that makes the hook 10 ascend and descend. When the switch (the changeover switch 25) selects one, the control device 20 controls the hydraulic motor 54 on the basis of the basic control signal S (manual control signal Sm) of the hydraulic motor 54 to stop the lifting operation.

When the switch 25 selects the other, the control device 20 applies the notch filter F to the basic control signal Sm of the hydraulic motor 54 to create the filtering control signal Sf (manual filtering control signal Sfm). Then, the control device 20 controls the hydraulic motor 54 on the basis of the filtering control signal Sfm to stop the lifting operation. According to such a crane 1, the operation characteristics can be selected for the control mode when the lifting operation of the hook 10 is stopped.

In the crane 1, the swing frequency of the load W is set to the resonance frequency ω in order to suppress the swing of the load W caused by the lifting operation of the hook 10. However, in order to suppress the swing of the boom 7 itself caused by the lifting operation of the hook 10, the swing frequency of the boom 7 may be set to the resonance frequency ω. Further, the resonance frequency ω may be set in consideration of both the swing frequency of the load W and the swing frequency of the boom 7.

In addition, in the crane 1, the operator operates the changeover switch 25 to select the control mode, but the invention is not limited thereto. For example, the changeover switch 25 may be incorporated in the arithmetic device of the control device 20 and may be configured in advance so as to select a desired control mode. Alternatively, the configuration may be such that an appropriate control mode is automatically selected according to the situation. That is, the changeover switch 25 is not limited to being manually operated.

Next, other characteristic points of the crane 1 will be described.

Figure 16:
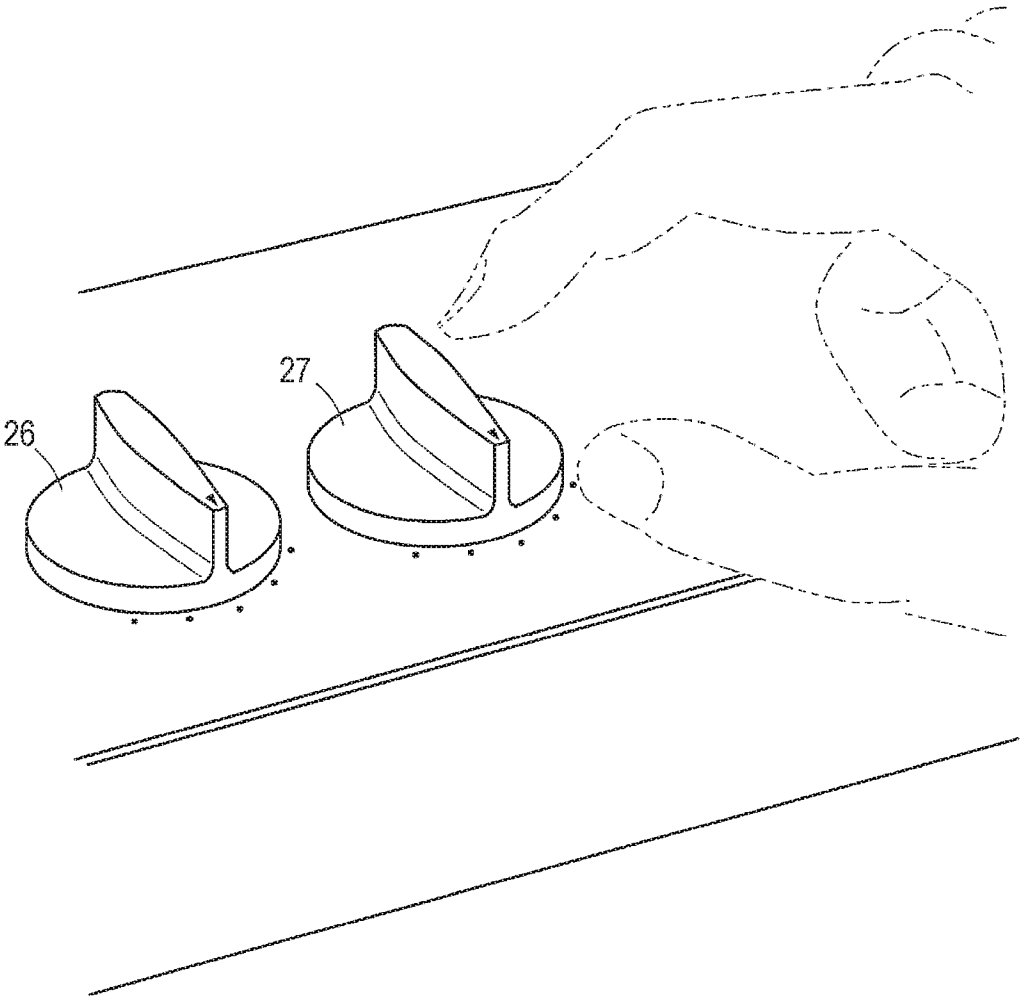
FIG. 16 is a diagram illustrating an adjustment dial provided inside the cabin.

As illustrated in FIG. 16, the crane 1 includes the adjustment dials 26 and 27. The adjustment dials 26 and 27 are disposed within the reach of the operator. Therefore, the operator can freely turn the adjustment dials 26 and 27. Note that only the adjustment dial 26 is illustrated in FIG. 2. In FIG. 2, the adjustment dial 27 may be provided at a position (for example, adjacent to the right side in FIG. 2) that is separated from and brought into contact with the adjustment dial 26.

The adjustment dial 26 changes the notch depth Dn by selecting the notch depth coefficient δ for automatic stop. The adjustment dial 27 changes the notch depth Dn by selecting the notch depth coefficient δ for manual stop. The adjustment dial 26 corresponds to an example of a second filter characteristic setting unit. The adjustment dial 27 corresponds to an example of a first filter characteristic setting unit.

The control device 20 uses the notch filter F set by the adjustment dial 26 to generate the automatic filtering control signal Sfa. Similarly, the control device 20 uses the notch filter F set by the adjustment dial 27 to generate the manual filtering control signal Sfm.

The adjustment dial 26 can select 1 for the notch depth coefficient δ. In this case, the control device 20 controls the actuators 51 to 54 on the basis of the automatic control signal Sa. Further, the adjustment dial 27 can also select 1 for the notch depth coefficient δ. In this case, the control device 20 controls the actuators 51 to 54 on the basis of the manual control signal Sm.

As described above, the crane 1 is provided with the adjusting tools (the adjustment dials 26 and 27). Then, the strength of the notch filter F can be adjusted by operating the adjusters 26 and 27. According to the crane 1, it is possible to more finely match the operation feeling of the operator.

Lastly, in the present application, the notch filter F is used as a filter that creates the filtering control signal Sf, but the invention is not limited thereto. That is, any band stop filter that can attenuate or reduce only a specific frequency band may be used. For example, a band limit filter or a band elimination filter may be used.

The entire contents of specification, drawings, and abstract contained in Japanese Patent Application No. 2018-035210, filed on Feb. 28, 2018 are incorporated herein.

REFERENCE SIGNS LIST

1 crane
2 traveling body
3 turning body
4 front tire
5 rear tire
6 outrigger
7 boom
8 wire rope
9 winch
10 hook
11 cabin
20 control device
20*a* basic control signal creation unit
20*b* resonance frequency calculation unit
20*c* filter coefficient calculation unit
20*d* filtering control signal creation unit
21 turning operation tool
22 telescopic operation tool
23 derricking operation tool
24 winding operation tool
25 changeover switch (switch)
26 adjustment dial (adjustment tool)
27 adjustment dial (adjustment tool)
31 turning valve
32 telescopic valve
33 derricking valve
34 winding valve
40 weight sensor
41 turning sensor
42 extension/contraction sensor
43 derricking sensor
44 winding sensor
51 turning hydraulic motor (actuator)
52 telescopic hydraulic cylinder (actuator)
53 derricking hydraulic cylinder (actuator)
54 winding hydraulic motor (actuator)
F notch filter (filter)
S basic control signal
Sa automatic control signal
Sm manual control signal
Sf filtering control signal
Sfa automatic filtering control signal
Sfm manual filtering control signal
W load

The invention claimed is:

1. A crane, comprising:

a operable functional unit;

an operation unit that receives an operation input for operating the operable functional unit;

an actuator that drives the operable functional unit;

a first generation unit that generates a first control signal for the actuator on the basis of the operation input;

a switch unit that can be switched between a first state and a second state;

a first filter unit that filters the first control signal to generate a second control signal when the switch unit is in the second state; and a control unit that controls the actuator on the basis of the first control signal when the switch unit is in the first state, and controls the actuator on the basis of the second control signal when the switch unit is in the second state.

2. The crane according to claim 1, wherein the control unit is configured to stop the actuator on the basis of the first control signal to stop the actuator in the first state of the switch unit, and stop the actuator on the basis of the second control signal to stop the actuator in the second state of the switch unit.

3. The crane according to claim 1, further comprising:

a second generation unit that generates a third control signal to stop the actuator in an automatic operation mode; and a second filter unit that generates a fourth control signal by filtering the third control signal in the automatic operation mode, wherein the control unit stops the actuator in the automatic operation mode on the basis of the fourth control signal.

4. The crane according to claim 3, wherein the first filter unit and the second filter unit have different filter characteristics.

5. The crane according to claim 3, further comprising:

a distance setting unit that sets, in the automatic operation mode, a moving distance of the operable functional unit from when the third control signal is input until the stop of the operable functional unit.

6. The crane according to claim 3, further comprising:

a first filter characteristic setting unit that sets a filter characteristic of the first filter unit; and a second filter characteristic setting unit that sets a filter characteristic of the second filter unit.

7. The crane according to claim 1, wherein the switch unit is manually switched by an operator.

8. The crane according to claim 1, wherein the switch unit is automatically switched.

9. The crane according to claim 1, wherein the operable functional unit is a boom, and the actuator is an actuator for performing at least one of a turning operation, a telescopic operation, and a derricking operation of the boom.

10. The crane according to claim 1, wherein the operable functional unit is a winch for raising and lowering a hook suspended by a wire rope at a tip of a boom, and the actuator is an actuator for driving the winch.

* * * * *